United States Patent [19]

Van Ketel

[11] Patent Number: 4,673,093

[45] Date of Patent: Jun. 16, 1987

[54] PROCESS FOR MOORING A CRANE FOR HEAVY LOADS

[75] Inventor: Hendrik Van Ketel, Maasluis, Netherlands

[73] Assignee: Gusto Engineering C.V., Schiedam, Netherlands

[21] Appl. No.: 857,707

[22] PCT Filed: Jul. 16, 1985

[86] PCT No.: PCT/NL85/00029

§ 371 Date: Mar. 14, 1986

§ 102(e) Date: Mar. 14, 1986

[87] PCT Pub. No.: WO86/00608

PCT Pub. Date: Jan. 30, 1986

[30] Foreign Application Priority Data

Jul. 17, 1984 [NL] Netherlands ..... 8402263

[51] Int. Cl.[4] ..... B66C 23/26

[52] U.S. Cl. ..... 212/175; 212/192; 212/239; 212/262

[58] Field of Search ..... 212/175, 176, 179–182, 212/186, 189, 190, 192, 193, 195, 239, 262, 255; 114/123

[56] References Cited

U.S. PATENT DOCUMENTS

| | | | |
|---|---|---|---|
| 2,609,939 | 9/1952 | Davidson et al. | 212/186 |
| 2,738,884 | 3/1956 | Callouette et al. | 212/186 |
| 2,883,068 | 4/1959 | McIntyre | 212/239 |
| 3,664,516 | 5/1972 | Goudy | 212/186 |
| 3,768,664 | 10/1973 | Bauer et al. | 212/239 |
| 3,923,163 | 12/1975 | Brewer | 212/239 |
| 4,297,961 | 11/1981 | Johnson, Jr. . | |

FOREIGN PATENT DOCUMENTS

| | | | |
|---|---|---|---|
| 1180502 | 10/1964 | Fed. Rep. of Germany . | |
| 1264010 | 3/1968 | Fed. Rep. of Germany . | |
| 1271341 | 6/1968 | Fed. Rep. of Germany . | |
| 936754 | 7/1948 | France . | |
| 2133491 | 12/1972 | France . | |
| 2323623 | 4/1977 | France . | |
| 8102271 | 12/1982 | Netherlands . | |
| 850560 | 7/1981 | U.S.S.R. | 212/195 |

*Primary Examiner*—Joseph F. Peters, Jr.
*Assistant Examiner*—Stephen P. Avila
*Attorney, Agent, or Firm*—Young & Thompson

[57] ABSTRACT

A process for mooring a crane having a crane jib which is hingedly connected to a slewing frame, luffing wires for luffing the crane jib in and out, and a guy mast hingedly connected with the top of the frame, the luffing wires passing about hoisting blocks at the top of the frame. The process comprises positioning the crane jib in a fully luffed-in position, and connecting at least one guy wire between a fixed point at a distance from the crane and the free end of said guy mast. Some of the luffing hoisting blocks are then detached from the frame and are shifted toward the free end of the guy mast and are attached to that free end of the guy mast. The luffing wires are then tightened to swing the guy mast to a position to tension the guy wire by raising that end of the guy wire which is secured to the guy mast, after which the crane jib is luffed out.

3 Claims, 5 Drawing Figures

PROCESS FOR MOORING A CRANE FOR HEAVY LOADS

The invention relates to a process for mooring a crane for heavy loads, in particular an offshore crane, provided with a crane jib which is hingedly connected to a slewing frame and by means of luffing wires can be luffed in and out, while to increase the maximum permissible load some of the luffing wires are extended by means of mooring wires which are fixed some distance away from the crane.

Cranes with such a "tie-back" system, which extends some of the luffing wires, are known and are used to permit an increase of the maximum permissible load. Both the foundation of the crane and the luffing wires are better loaded through use of the triangle of forces formed. For example, a 2000 ton crane is made suitable for a load of 3000 tons. It is important for the guy wires to be fastened a good distance away from the crane, for example on the deck of the crane pontoon. The further away this fastening point is from the crane, the greater the radius of action of the crane jib can be and the more the load on the crane jib is reduced. In general, the distance between the fastening point of the guy wires and the crane is limited, which means that the advantage of the greater radius and the higher permissible crane load is subject to limitations, for the extended luffing wires must always remain above the non-extended luffing wires in order to produce the above-mentioned advantages.

The object of the invention is, starting from the crane mentioned in the preamble, in the case of which there is a certain distance between the fixed fastening point of the guy wires and the crane, to increase even more the maximum permissible crane load and the radius of action of the crane jib.

According to the invention, the process is to this end characterised in that provision is made in the assembly of interconnected guy wires and luffing wires, by means of a guy mast, for a kink facing away from the crane.

As a result of said kink, there will be a greater angle between the extended luffing wires and the luffing wires which are not extended. It is this greater angle which leads to the advantage of the greater radius of action and a reduction of the load of the crane jib.

The guy mast is preferably disposed so that with one end it hinges on the top of the frame and with its other end forms a connection between the guy and luffing wires.

According to the invention, the crane jib is maintained in the fully luffed-in position, and one or more guy wires are provided between a fixed point at a distance from the crane and the free end of a guy mast hingedly connected with the top of the frame, while some of the luffing hoisting blocks at the top end of the frame are detached from the frame and moved towards the free end of the guy mast and attached to that end, and the guy mast is pivoted into the working position through tightening of the luffing wires connected with said mast, and finally, the crane jib is released for luffing out.

For maintaining the crane jib in the fully luffed-in position, use is preferably made of a temporary connection between crane jib and frame, this connection being removed at the end of the luffing procedure.

In order to guide the movable luffing hoisting blocks during their movement towards the free end of the guy mast in such a way that they cannot strike parts of the crane, separate guide channels could be used. It is, however, cheaper if the guy mast serves as the guide for said blocks during the movement of these movable luffing hoisting blocks.

The invention will now be explained further with reference to the schematic figures.

Figure 2:
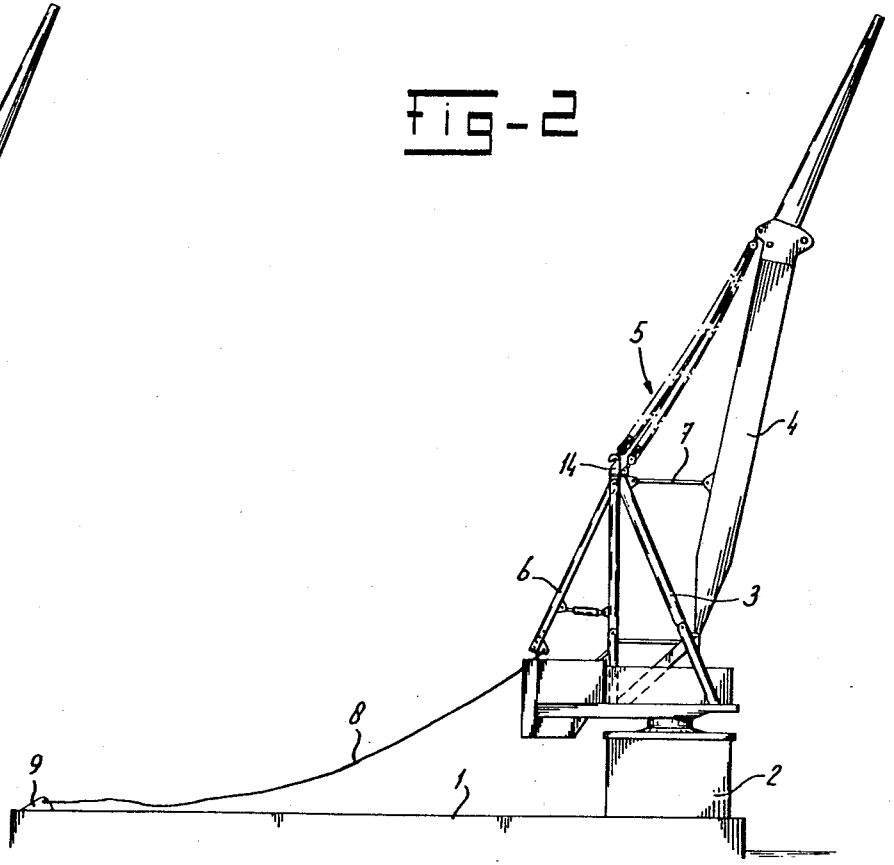
FIGS. 1 to 4 show views of the crane in the various stages which are necessary to practice the special mooring process according to the invention, with the lines drawn in FIG. 4 indicating the end stage.

The offshore crane shown in the figures comprises a pontoon 1, a support 2, an A-frame 3 slewably mounted on said support and a crane jib 4 which is hingedly connected to said frame and can be luffed in and out by means of at least one luffing hoist 5.

Suspended in hinging fashion from the top of the A-frame is a guy mast 6. The idea is to moor the crane in such a way that it can take a considerably greater load and the crane jib can have a relatively great radius of action.

Figure 1:
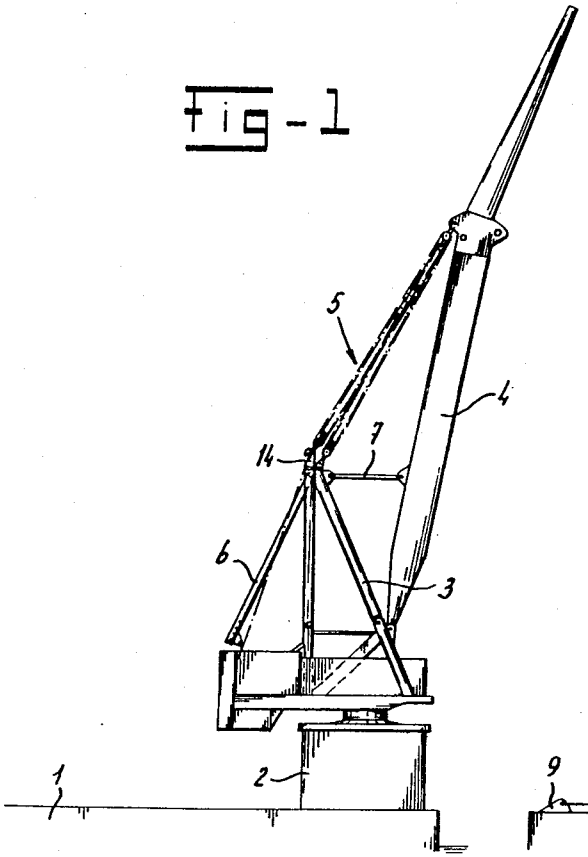

The mooring procedure begins with the position shown in FIG. 1, where the crane is slewed in such a way that the crane jib is projecting with minimum radius over one side (for example, the rear side) of the pontoon. Disposed between the crane jib and the A-frame is a temporary connection 7, for example in the form of one or more pipes or rods. There is nothing to to stop use of part of the luffing hoist for retaining the crane jib in this luffed-out position.

FIG. 2 shows that guy wires 8 are provided between the free end of the guy mast 6 and a fastening point 9 provided at a distance from the crane on the pontoon.

Figure 3:
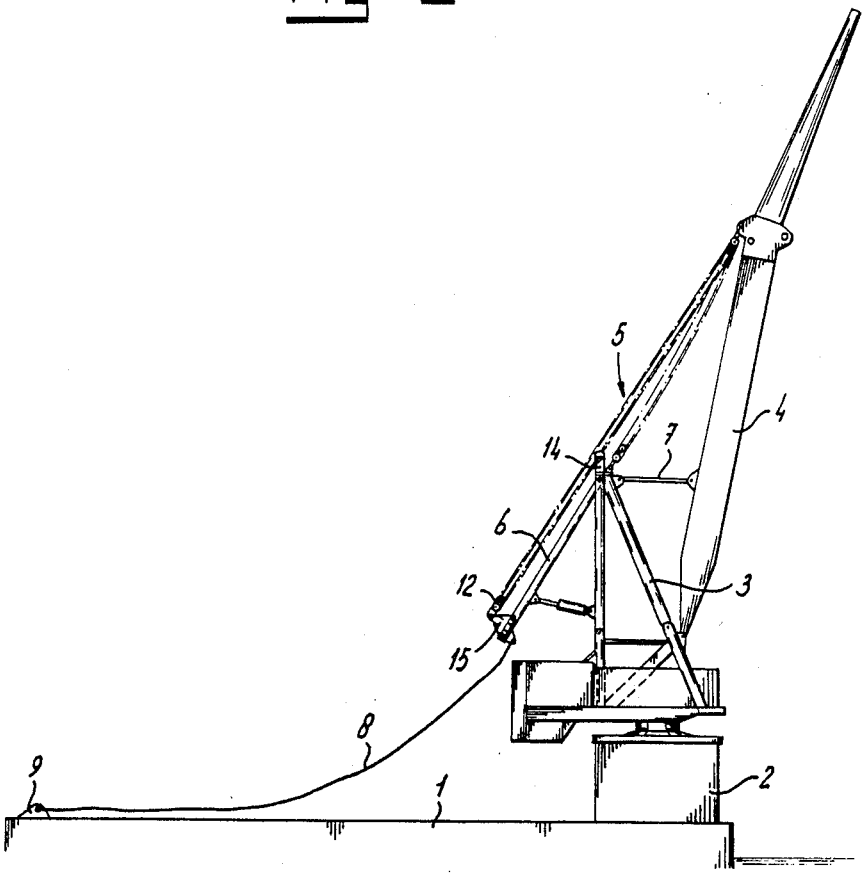

By means of a hydraulic cylinder 11 or other means such as an auxiliary winch, the guy arm is moved into a position in which it is in line with the guy wires of the luffing hoist (FIG. 3).

Figure 5:
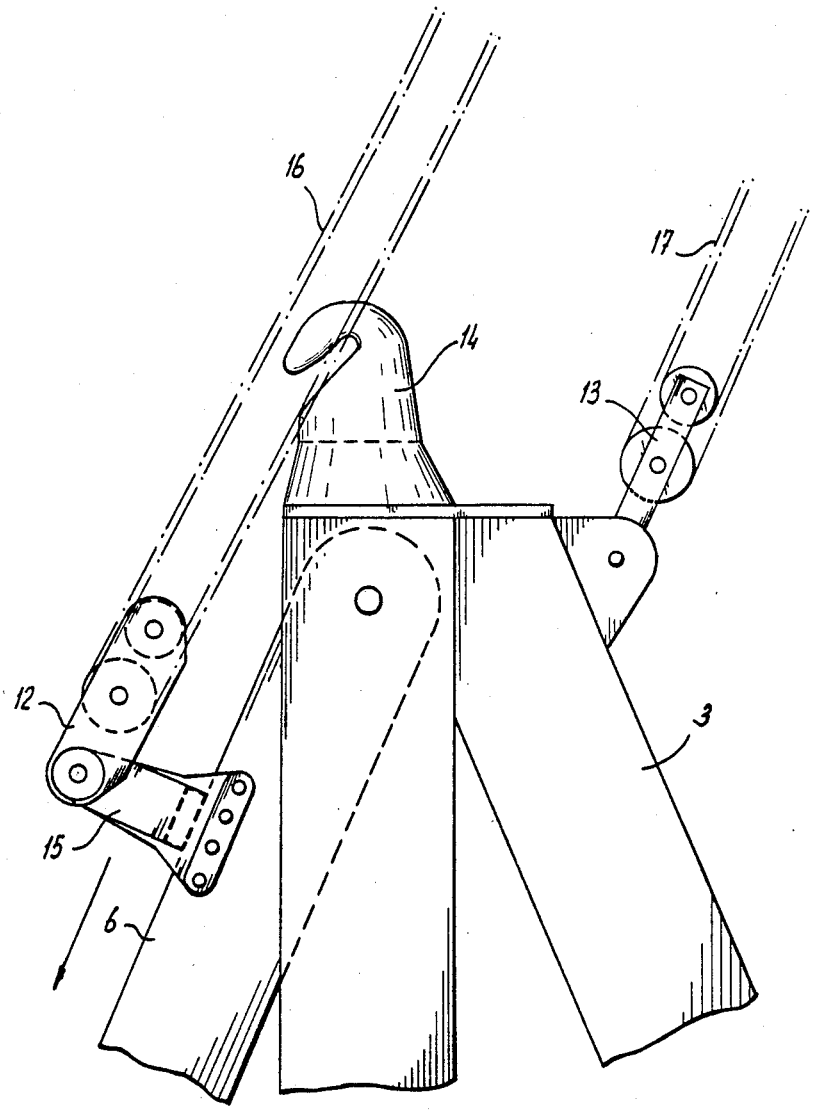
FIG. 5 shows a view of the top side of the crane frame of the crane for practicing the invention, on a larger scale.

The wires of the luffing hoist are veered out, and some of the bottom blocks are detached from the A-frame (for example with an auxiliary winch). In schematic FIG. 5 the detached luffing hoist bottom blocks are indicated by reference number 12, and the fixed luffing hoist bottom blocks are indicated by 13. The hinge pins of the loose blocks 12 rest in hook-shaped consoles 14 which are open on one side.

In the construction shown the hoist comprises, for example, four bottom blocks of which the two innermost blocks 13 have a fixed hinge connection with the frame 3, while the two outermost blocks 12 are connected to each other by means of a U-shaped guide construction 15. The bottom blocks 12 glide downwards with their guide construction 15 along the mast 6 to the free end of said mast, where a connection is produced between said free end and the construction 15 (FIG. 3).

Figure 4:
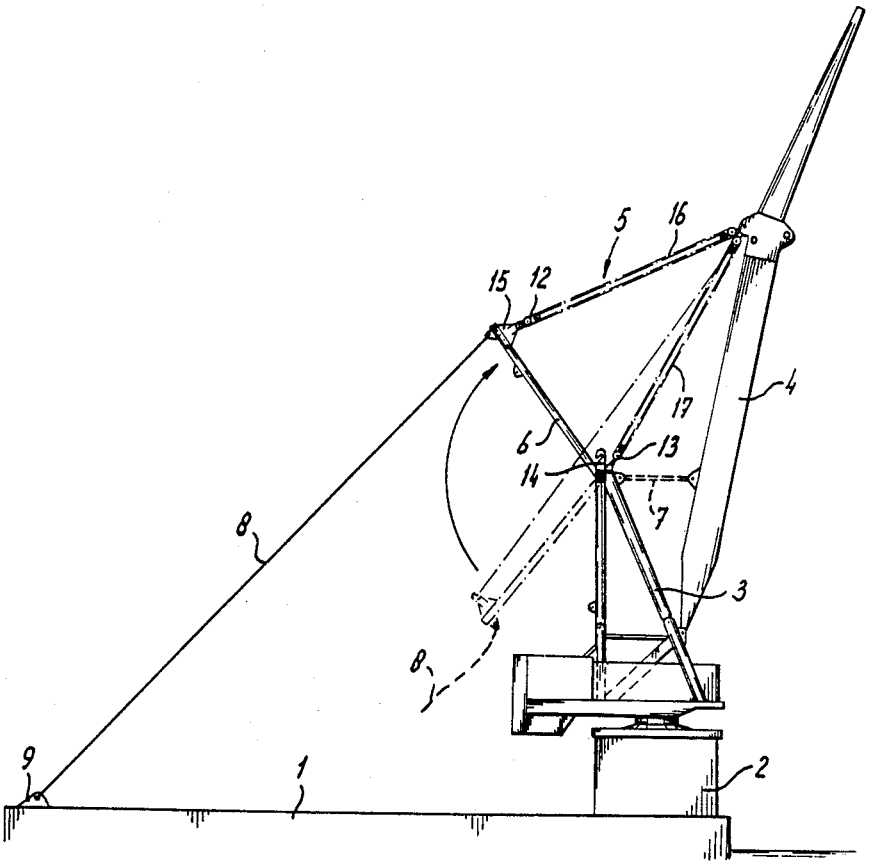

Finally, the guy mast 6, after being pushed or pulled over the dead point, is slewed up by hauling tight the luffing wires (FIG. 4) to a position in which the guy wires 8 are taut.

After removal of the temporary connection 7, the crane is ready for use. The luffing wires supported by the movable bottom blocks 12 are indicated by reference number 16, and the luffing wires supported by the fixed bottom blocks 13 are indicated by reference number 17.

Due to the fact that in the assembly of interconnected guy wires 8 and luffing wires 16 an outward kink is provided by means of the guy mast 6, the angle between the fixed luffing wires 17 and the luffing wires 16 acting as an extension of the guy wires 8 is increased. The maximum radius during luffing out of the jib 4 is thereby considerably increased, for the luffing wires 16 and 17 will run parallel much less quickly than would be the case without the kink caused by the mast 6. Besides, the mooring system described takes the load off the crane jib, so that a greater crane load is possible.

It will be clear that the crane moored according to the invention can slew over little or no angle. In fact, a floating derrick has been made of the slewable crane.

Various modifications are possible within the scope of the invention. In order to guide the loose bottom block construction 12, 15, use can be made of individual channels instead of the mast 6. What is essential for the invention is that in the mooring system known per se, consisting of separate guy wires and some of the luffing wires connected thereto, provision is made by means of a separate guy mast for a kink facing away from the crane. The guy mast need not necessarily be connected to the A-frame.

I claim:

1. A process for mooring a crane having a crane jib which is hingedly connected to a slewing frame, luffing wires for luffing the crane jib in and out, and a guy mast hingedly connected with the top of the frame, the luffing wires passing about hoisting blocks at the top of the frame, the process comprising positioning the crane jib in a fully luffed-in position, connecting at least one guy wire between a fixed point at a distance from the crane and the free end of said guy mast, detaching some of the luffing hoisting blocks from the frame and shifting said blocks toward the free end of the guy mast and attaching the shifted blocks to said free end of the guy mast, tightening the luffing wires to swing the guy mast to a position to tension the guy wire by raising that end of the guy wire which is secured to the guy mast, and luffing out the crane jib.

2. A process as claimed in claim 1, and establishing a temporary connection between the crane jib and the frame for maintaining the crane jib in said fully luffed-in position, and removing said connection for luffing out the jib.

3. A process as claimed in claim 1, in which the movement of said hoisting blocks toward the free end of the guy mast is effected by sliding the blocks along the guy mast using the guy mast as a guide for the blocks.

* * * * *